United States Patent [19]

Tamamura

[11] Patent Number: 4,966,662

[45] Date of Patent: Oct. 30, 1990

[54] PROCESS FOR PREPARING PRASEODYNIUM METAL OR PRASEODYMIUM-CONTAINING ALLOY

[75] Inventor: Hideo Tamamura, Chichibu, Japan

[73] Assignee: Showa Denko Kabushiki Kaisha, Tokyo, Japan

[21] Appl. No.: 396,701

[22] Filed: Aug. 22, 1989

[30] Foreign Application Priority Data

Aug. 22, 1988 [JP] Japan ..... 63-206459

[51] Int. Cl.[5] ..... C25C 3/34; C25C 3/36

[52] U.S. Cl. ..... 204/71; 204/64 R

[58] Field of Search ..... 204/64 R, 71

[56] References Cited

U.S. PATENT DOCUMENTS 3,729,397 4/1973 Goldsmith et al. ..... 204/64 R 4,627,898 12/1986 Ghandahari ..... 204/64 R

FOREIGN PATENT DOCUMENTS 253391 11/1986 Japan .

OTHER PUBLICATIONS

E. Morrice et al., U.S. Dept. Interior, Report of Investigations 6957, (1967).

E. Morrice et al., U.S. Dept. Interior, Report of Investigations 7146, (1968).

R. E. Toma, Progress in Science and Technology of the Rare Earths, vol. 2, p. 110, Pergamon Press, New York, 1966.

*Primary Examiner*—G. L. Kaplan

*Attorney, Agent, or Firm*—Sughrue, Mion, Zinn, Macpeak & Seas

[57] ABSTRACT

A process for the preparation of a praseodymium-iron alloy or a praseodymium-neodymium-iron alloy, which comprises using praseodymium fluoride ($PrF_3$) or a mixture of praseodymium fluoride and neodymium fluoride ($NdF_3$) as the starting material and carrying out the electrolysis in fused a salt bath having a composition comprising substantially 5 to 34% by weight of $PrF_3$ or a mixture of $PrF_3$ and $NdF_3$ and 95 to 66% by weight of lithium fluoride (LiF) by using an iron cathode, and a process for the preparation of praseodymium metal or a praseodymium-neodymium alloy which comprises using praseodymium fluoride ($PrF_3$) or a mixture of praseodymium fluoride and neodymium fluoride ($NdF_3$) as the starting material and carrying out the electrolysis in a fused salt bath having a comprising substantially 5 to 75% by weight of $PrF_3$ or the mixture of $PrF_3$ and $NdF_3$ and 95 to 25% by weight of lithium fluoride (LiF) by using a cathode of carbon or an infusible metal.

20 Claims, 7 Drawing Sheets

CRITICAL CURRENT DENSITY, BATH COMPOSITION AND TEMPERATURE

BOTH COMPOSITION AND CURRENT EFFICIENCY

CRITICAL CURRENT DENSITY,
BATH COMPOSITION AND TEMPERATURE

BATH COMPOSITION AND CURRENT EFFICIENCY

PROCESS FOR PREPARING PRASEODYNIUM METAL OR PRASEODYMIUM-CONTAINING ALLOY

BACKGROUND OF THE INVENTION

1. Field of the Invention

The present invention relates to a process for the preparation of praseodymium (Pr) metal, a praseodymium-neodymium (Pr-Nd) alloy, or an iron alloy thereof (Pr-Fe or Pr-Nd-Fe). More particularly, the present invention relates to a process for preparing the above-mentioned metal or alloy by the fused salt electrolytic method using praseodymium fluoride or praseodymium fluoride and neodymium fluoride as the starting material. Especially, the present invention relates to a process in which a high-purity metal or alloy suitable for a magnetic material of the Pr type or Pr-Nd type, which recently has attracted attention for high-performance magnets, can be manufactured at a low cost.

2. Description of the Related Art

As a relatively cheap high-performance permanent magnet, there has recently been proposed a magnet formed by substituting a part of the Sm type magnet composition by Pr or a Pr-Nd alloy, or a permanent alloy of the (Pr, Nd)-Fe-B type or (Pr, Nd)-Fe-Co-B type. As the method for preparing Pr, Pr-Nd, or an iron alloy thereof to be used for such permanent alloys, the following methods are known.

(1) A method comprising reducing a Pr compound or Pr-Nd compound with an active metal such as metallic calcium.

(2) A method comprising carrying out alloying reaction between Pr oxide or Pr-Nd oxide and iron used as the cathode by fused salt electrolysis to collect Pr, Pr-Nd, or an Fe alloy thereof (E. Morrice et al, Bur. Mine Rep. Invest., No. 7146, 1968).

(3) A method comprising carrying out an alloying reaction between Pr fluoride or Pr-Nd fluoride and iron used as the cathode by the fused salt electrolysis to collect a Pr-Fe or Pr-Nd-Fe alloy (Japanese Unexamined Patent Publication No. 61-253391).

These three methods are now compared with one another. The first method is disadvantageous from the economical viewpoint and in view of the low productivity because an expensive metal such as calcium is used as the reducing agent and the reaction is carried out batchwise.

In the second method, since the solubility of the oxide in the fused salt is low, if the oxide is fed in an amount exceeding the solubility, the oxide is incorporated in the lower portion of the fused salt, that is, in the deposited metal, to form a mixture of the metal with the fused salt and oxide, and the second method is defective in that recovery of a high-grade metal is difficult.

In the third method, the dissolution of the fluoride in LiF as the fused salt forms a eutectic mixture and the dissolution range is broad. The metal can be recovered without trouble as observed in the oxide electrolysis method. Accordingly, the third method is excellent in this point.

However, as the result of investigations made by the inventor, it has been confirmed that the method disclosed in Japanese Unexamined Patent Publication No. 61-253391 has problems described below and is not suitable for preparing a Pr-Fe or Pr-Nd-Fe alloy economically advantageously on an industrial scale.

According to the method disclosed in Japanese Unexamined Patent Publication No. 61-253391, Pr fluoride or a mixture of Pr fluoride and Nd fluoride is maintained at a concentration of 35 to 76% by weight in an electrolytic bath composed mainly of LiF and a Pr-Fe or Pr-Nd-Fe alloy is deposited while maintaining the temperature of the electrolytic bath at 770° to 950° C. The reason why the amount of $PrF_3$ as the starting compound or the starting $PrF_3$-$NdF_3$ mixture is limited to 35 to 76% by weight is as follows. The phase diagram of LiF-$PrF_3$ shown in FIG. 5 is the eutectic phase diagram. The melting points of LiF, $PrF_3$, and LiF-$PrF_3$ at the eutectic point (the composition where the amount of $PrF_3$ is about 67% by weight) are about 850° C., higher than about 1300° C. and about 730° C., respectively. Accordingly, it is considered that the above-mentioned composition of the LiF-$PrF_3$ system is selected so that the melting point of the bath is lower than about 840° C.. The phase diagram of the LiF-$NdF_3$ is substantially the same as described above, and the same can be said with respect to the bath composition for the production of a Pr-Nd-Fe alloy (R. E. Thoma, Progress in Science and Technology of the Rare Earths, Vol. 12, page 110, Pergamon Press, New York, 1966). In the production of a metal by the fused salt electrolytic method, for the reasons set forth below, it is preferred that the electrolysis temperature be lower. Accordingly, it is considered that the composition of the fused salt be such that the operation is carried out on the fused salt having a low melting point. It is considered that the above-mentioned composition is selected from this viewpoint.

(1) When the operation is carried out at a low temperature, the damage of the electrolytic cell material is small, and also the evaporation loss of the electrolytic bath is small.

(2) An energy-saving effect is attained when the operation is carried out at a lower temperature.

(3) In the fused salt electrolysis, the once deposited metal is formed into metal mists again and these metal mists react with the bath components to form the starting material. This reaction is conspicuous as the temperature is higher. It is considered that the ratio of the actually recovered amount of the metal to the theoretical value, calculated based on this balance, that is, the current efficiency, is reduced as the temperature is higher.

However, as the result of investigations made by us, it was confirmed that in the fluoride electrolysis, unlike the known oxide or chloride electrolysis, the reaction is advanced through a complicated mechanism, and the above-mentioned composition is not economically desirable.

The following two points are important for producing a metal economically advantageously by the fused salt electrolysis.

(1) Critical Current Density

In the fused salt electrolysis, as the current per unit area of the electrode increases, a peculiar phenomenon called "the anode effect" arises. In order to perform the electrolysis stably, it is ordinarily necessary to carry out the operation at a current density lower than the critical current density. If the critical current density is low, in order to apply a certain quantity of an electric current, it is necessary to increase the electrode area, and hence, the size of an electrolytic cell in which electrodes are placed should be increased. This results in increase of the size of the furnace and increase of the equipment cost. A large quantity of expensive fused salt should be used, and the production becomes economically disadvantageous. Therefore, in order to produce a metal economically advantageously, it is preferable to carry out the operation under a condition of a high critical current density. According to our research, it was found that in the electrolysis for the production of rare earth metals, since this critical current density is not substantially influenced by the cathode current density but is mainly determined by the anode current density, it is preferable to carry out the operation under a condition where the anode current density is substantially high.

(2) Current Efficiency

As pointed out hereinbefore, the quantity of the metal produced by the electrolysis is calculated by multiplying the theoretical value calculated by Faraday,s law by the current efficiency. If the current efficiency is low, the amount produced of the metal does not increase in proportion to the quantity of the electric current applied, and therefore, a higher current efficiency is desired.

Under this background, the inventor made research with a view to developing a process capable of producing a metal economically advantageously, and, as a result, the inventor found that the conditions disclosed in Japanese Unexamined Patent Publication No. 61-253391 mentioned above are not the absolutely optimum conditions and Pr-Fe and Pr-Nd-Fe alloys can be prepared very economically advantageously under different conditions. The inventor has now completed the present invention based on this finding.

SUMMARY OF THE INVENTION

It is therefore a primary object of the present invention to provide a process for preparing excellent Pr-Fe and Pr-Nd-Fe alloys economically advantageously.

The process disclosed in the above-mentioned patent publication is a process for the preparation of Pr-Fe and Pr-Nd-Fe alloys. However, in some cases, it is preferable to recover Pr metal or Pr-Nd metal (alloy) instead of the iron alloy. For example, the following cases can be mentioned.

(1) In the production of a magnetic material, alloying with other rare earth metals such as samarium is sometimes effected. Compositions used in this case are not limited to those containing Fe. Accordingly, if only rare earth metals free of Fe are recovered, the utilization range can be broadened.

(2) Use of Pr or Pr-Nd metal as a photomagnetic recording material is investigated and in this case, a composition free of Fe is often used.

Therefore, establishment of a technique of producing Pr metal and Pr-Nd metal instead of Fe alloys by the fused salt electrolytic method is necessary.

Accordingly, another object of the present invention is to provide a process for preparing Pr or Pr-Nd metal ecohomically advantageously.

In accordance with the present invention, the primary object can be attained by a process for the preparation of a praseodymium-iron alloy or a praseodymium-neodymium-iron alloy, which comprises using praseodymium fluoride ($PrF_3$) or a mixture of praseodymium fluoride and neodymium fluoride ($NdF_3$) as the starting material and carrying out the electrolysis in a fused salt bath having a composition comprising substantially 5 to 34% by weight of PrF or a mixture of $PrF_3$ and $NdF_3$ and 95 to 66% by weight of lithium fluoride (LiF) by using an iron cathode.

As pointed out hereinbefore, the inventor made experiments under various conditions for finding out the conditions for preparing Pd-Fe or Pr-Nd-Fe alloy economically advantageously, and, as a result, we found that in the melt salt electrolysis of $PrF_3$ or a mixture of $PrF_3$ and $NdF_3$ as the starting material by using an Fe cathode, if the composition of the fused salt comprises substantially 5 to 34% by weight of $PrF_3$ or the mixture of $PrF_3$ and $NdF_3$ and 95 to 66% by weight of LiF, as shown in FIGS. 1 and 2, the critical current density and current efficiency are critically increased.

The inventor previously proposed the process of the fused salt electrolysis for the production of rare earth metals and rare earth metal alloys, which comprises carrying out the electrolysis by using plate-shaped cathode and anode in an oxygen-containing atmosphere. If the above-mentioned process of the present invention is carried out in an oxygen-containing atmosphere by using plate-shaped electrodes according to the previous proposal, prominent effects are attained, as described hereinafter. However, even if the above-mentioned process of the present invention is carried out in an inert gas atmosphere by using rod-shaped electrodes according to the conventional technique, effects are similarly attained though the efficiency is reduced to some extent.

In accordance with the present invention, the other object can be attained by a process for the preparation of praseodymium metal or a praseodymiumneodymium alloy, which comprises using praseodymium fluoride ($PrF_3$) or a mixture of praseodymium fluoride and neodymium fluoride ($NdF_3$) as the starting material and carrying out the electrolysis in a fused salt bath having a composition comprising substantially 5 to 75% by weight of $PrF_3$ or the mixture of $PrF_3$ and $NdF_3$ and 95 to 25% by weight of lithium fluoride (LiF) by using a cathode of carbon or an infus.blre metal.

In the conventional process for the production of a rare earth metal by fused salt electrolysis, in general, graphite is used for the anode and tungsten, molybdenum, or the like is used for the cathode, and the electrolysis is carried out in an inert gas atmosphere for preventing high-temperature oxidation of the cathode or oxidation of the formed metal (Bur. Mine Rep., 6957, 1967).

The inventor previously proposed a process for the production of rare earth metals and rare earth metal alloys, which comprises carrying out the fused salt electrolysis in an oxygen-containing atmosphere, It has been found that if the above-mentioned process of the present invention is carried out in an oxygen-containing atmosphere by using carbon or an infusible metal such as tantalum, tungsten, or molybdenum especially tantalum as the cathode, Pr or Pr-Nd metal is preferably prepared, though the process of the present invention is not limited to this feature.

The electrolytic collection of Pr metal may seem to resemble the electrolytic collection of a Pr-Fe alloy, but they are quite different from each other in the electrochemical mechanism. The reaction will now be described with reference to an example in which $PrF_3$ is used as the starting material. In the case where a Pr-Fe alloy is prepared by using a graphite anode and an iron cathode, a reaction of $nC+mF^{-}CnFm+me^{-}$ is caused on the anode while a reaction of $Fe+Pr^{3+}+3e^{-}\rightarrow$ Pr-Fe alloy is caused on the cathode, and both the electrodes are consumable electrodes. In contrast, in the case where Pr metal is prepared by using a graphite anode and a graphite cathode, a reaction of $nC+mF^- \rightarrow CnFm+me^-$ is caused on the anode while $Pr^{3+}+3e^- \rightarrow$ Pr metal is caused on the cathode, and the anode is a consumable electrode but the cathode is an unconsumable electrode.

The inventor conducted fused salt electrolysis of $PrF_3$ or a mixture of $PrF_3$ and $NdF_3$ under various conditions according to the above-mentioned process so as to find out economically advantageous conditions where the critical current density and the current efficiency are high. As the result, it was found that in a fused salt bath composition comprising 5 to 75% by weight of $PrF_3$ or a mixture of $PrF_3$ and $NdF_3$ and 95 to 25% by weight of LiF, as shown in FIGS. 3 and 4, Pr or Pr-Nd metal can be prepared economically and advantageously at a high critical current density and current efficiency. It also was found that a composition comprising 10 to 70% by weight of $PrF_3$ or a mixture of $PrF_3$ and $NdF_3$ and 90 to 30% by weight of LiF is especially preferred.

This tendency is similarly observed when an inert gas atmosphere is used, though the efficiency is low. By the electrolysis adopting the above-mentioned electrode construction and the above-mentioned bath composition, Pr or Pr-Nd can be prepared economically advantageous.

DESCRIPTION OF PREFERRED EMBODIMENTS

Figure 1:
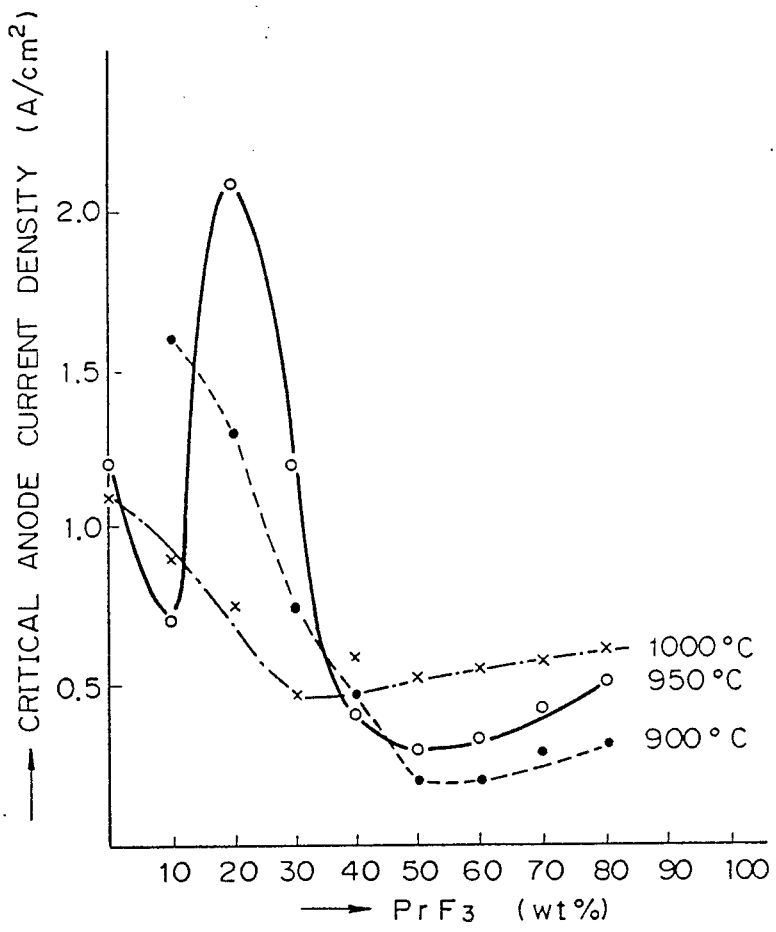
FIG. 1 is a graph illustrating the relations of the critical current density to the bath composition and temperature in the electrolysis for the production of a Pr-Fe alloy in a mixed bath of $PrF_3$ and LiF.

The fused salt electrolytic bath used in the present invention comprises substantially $PrF_3$ or a mixture of $PrF_3$ and $NdF_3$ and LiF. The reason why a mixture of $PrF_3$ and $NdF_3$ can be used as well as $PrF_3$ is as follows. Almost all Pr-containing minerals simultaneously contain Nd, and as is imagined from the positions of Pr and Nd in the Periodic Table, the chemical properties of Nd are quite similar to those of Pr. In the process for the extraction of Pr, Pr and Nd are commonly present to the final step, and separation of Nd from Pr results in increase of the cost. Moreover, there are application fields where a metal mixture of Pr and Nd can be used, in addition of application fields where Pr separated from Nd is necessary. Furthermore, in a fused salt electrolytic operation, this mixture shows an electrochemical behavior similar to that of $PrF_3$, and they need not be treated in different manners. Of course, other flux such as $CaF_2$, $BaF_2$, or $CeF_3$ can be added in a fused salt bath comprising $PrF_3$ or $PrF_3$-$NdF_3$ and LiF. In this case, $CaF_2$ or the like can be added at an external ratio of up to 50% by weight based on the above composition of LiF-$PrF_3$($NdF_3$).

In accordance with one preferred embodiment of the present invention, the electrolysis is carried out in an oxidizing atmosphere, especially an atmosphere containing 10 to 40% by volume, preferably 15 to 30% by volume, of oxygen (inclusive of an open air atmosphere), though the present invention is not limited to this embodiment. In this preferred embodiment, powdery carbon generated from the carbon electrode and floating on the bath is consumed by oxidation, and incorporation of carbon as an undesirable impurity into the metal (alloy) formed by the electrolysis can be prevented. It is said that in a magnetic material of the Pr or Pr-Nd system, it is necessary that the carbon content be lower than 400 ppm. According to this embodiment of the process of the present invention, the carbon content can be reduced below 200 ppm, especially below 100 ppm. In this oxidizing atmosphere, the critical current density can be increased. When the oxygen concentration is lower than 15% by volume, the amount of powdery carbon increases and when the oxygen concentration is lower than 10% by volume, the amount of powdery carbon increases and the normal operation becomes difficult. Moreover, the carbon concentration in the deposited metal abruptly increases. If the oxygen concentration increases 30% by volume, oxidative consumption of the portion, exposed above the bath surface, of the graphite electrode increases, and if the oxygen concentration exceeds 40% by volume, this oxidative consumption becomes conspicuous and troubles arise. Therefore, it is preferred that the oxygen concentration be adjusted within the above-mentioned range.

The electrode may have a rod-like shape, but a plate-like shape is preferable, since an electric current flows in a portion where the resistance is small, that is, along the shortest distance between the two electrodes. Accordingly, when rod-shaped electrodes are used, a high current density is locally produced, and if the critical anode current density is attained in the shortest distance section, the anode effect is produced. Therefore, the operation has to be carried out at a low current density. Moreover, even if the operation is carried out at a low current density, the electrode spacing is expanded with consumption of the electrode, and the surface of the electrode is changed (reduced) moment by moment to change the current density, with the result that the current density cannot be maintained stably. The current efficiency depends on the current density and the electrode spacing, but a problem arises in that the change of the electrode spacing is not constant. In contrast, in case of plate-shaped electrodes, since the areas of the confronting portions of the two electrodes are constant, it is possible to maintain the current density at an optimum value. Moreover, since the change of the electrode spacing is constant, it is possible to maintain the electrode spacing at an optimum value by moving the electrodes with the consumption of the electrodes. Moreover, the areas of the confronting portions of the two electrodes can be increased.

Figure 10A:
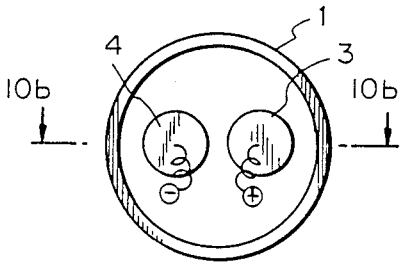
FIGS. 10A and 10B are diagrams illustrating shapes of electrodes used in the conventional technique.
Figure 10B:
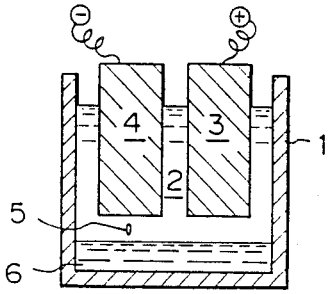
Fig. 10 B PRIOR ART
Figure 6A:
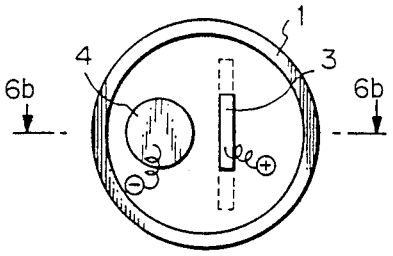
FIGS. 6A through 8B are diagrams illustrating shapes of electrodes used in the present invention.
Figure 6B:
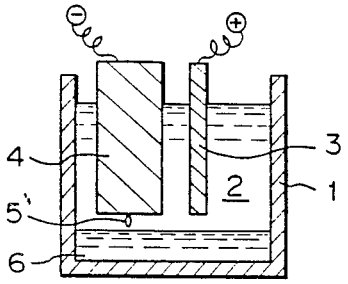
Figure 7A:
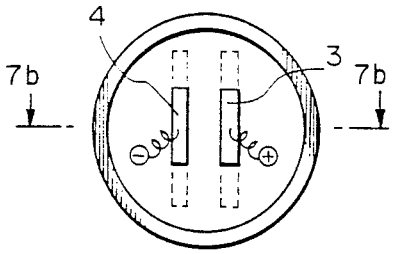
Figure 7B:
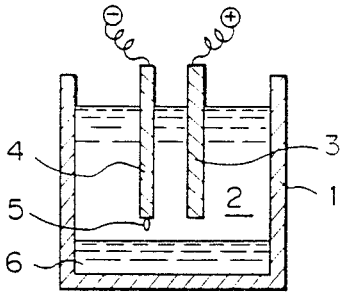
Figure 8A:
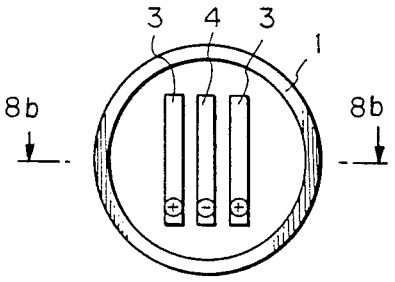
Figure 8B:
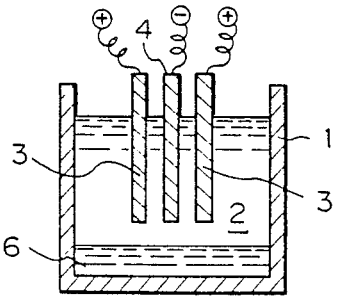

Examples of the conventional rod-shaped electrodes are shown in FIGS. 10A and 10B. In contrast, FIGS. 6A and 6B show an embodiment where a plate-shaped electrode is used only for the anode 3. If a plate-shaped electrode is used even only for the anode 3, the electrolytic reaction on the surface of the anode can be made constant and the anode effect can be controlled. This embodiment is effective as compared with the arrangement shown in FIGS. 10A and 10B. FIGS. 7A and 7B show an embodiment where plate-shaped electrodes are used as both of the anode 3 and cathode 4. For the reason set forth above, it is understood that this embodiment is more effective. In addition, since the surface area of the plate-shaped electrode is much larger than that of the rod-shaped electrode having the same volume, in order to obtain the same reaction area, the size of the plate-shaped electrode can be reduced, and therefore, in the same electrolytic cell, increase of the size of electrodes is allowed in case of plate-shaped electrodes. Therefore, in the embodiments shown in FIGS. 6 and 7, the shape of the plate-shaped electrode can be extended as indicated by a broken line, and the surface area of the electrode in the bath can be drastically increased, with the result that an electric current in a quantity about 2 times can be applied. In the fused salt electrolysis for the production of a rare earth metal, the critical current density is determined by the current density on the anode where the anode effect is caused, rather than the current density on the cathode. Accordingly, there can be adopted an arrangement where two plate-shaped anodes 3 are located to confront both the sides of a plate-shaped cathode 4. By adopting this arrangement, an electric current can be applied in a quantity about 2 times at the same anode current density to the electrolytic cell, and the productivity can be substantially doubled. Namely, the productivity is about 6 times the productivity in the arrangement shown in FIGS. 10A and 10B. Incidentally, in FIGS. 6 through 8 and 10, reference numeral 1 represents an electrolytic cell, reference numeral 2 represents a fused salt bath, reference numeral 3 represents an anode, reference numeral 4 represents a cathode, reference numeral 5 represents a metal or alloy deposited on the cathode and dropped therefrom and reference numeral 6 represents a recovered metal or alloy accumulated in the lower portion of the electrolytic cell after deposition on the cathode and dropping therefrom.

In the case where graphite is used as the electrode in an oxidizing atmosphere, the upper portion, covered with the oxidizing atmosphere above the electrolytic bath, of the electrode undergoes oxidative consumption. This portion can be coated with an antioxidant, or since graphite is a relatively cheap material, a throw-away graphite electrode can be used. The present invention is characterized in that the rate of electrolysis consumption of the graphite electrode is made higher than the rate of oxidative consumption of the graphite electrode by increasing the anode current density and, in such a case, the problem by oxidation is removed.

Use of tantalum for the cathode is preferable. Other infusible material (Mo or W) forms an alloy with Pr or the like and is incorporated in Pr as an impurity in an amount of several hundred to several thousand ppm, but this disadvantage is not brought about in case of tantalum. In order to prevent oxidation of the tantalum electrode, the reaction surface of the graphite electrode in the electrolytic bath can be coated with tantalum or only the reaction surface of the iron cathode can be coated with tantalum.

In the embodiments illustrated in FIGS. 6A through 8B, the main electrolytic reaction is caused between the anode and cathode, and cations leaking between the electrolytic cell and the anode and anions leaking between the electrolytic cell and the cathode move toward the electrolytic cell because of relative potentials thereof and react with stainless steel of the electrolytic cell, with the result that the life of the electrolytic cell is shortened and constituents of stainless steel, such as Ni and Cr, are incorporated as impurities in the recovered metal to reduce the purity of the recovered metal. This can be prevented by interposing a dummy electrode composed of an appropriate material between the electrode and the electrolytic cell, and better effects can be obtained.

As pointed out hereinbefore, the electrode spacing between the cathode and anode has serious influences on the current efficiency. Accordingly, it is preferred that the electrode spacing be 10 to 60 mm. If the electrode spacing is smaller than 10 mm, formed metal ions (Nd and Pr) are bonded to F ions again between the electrodes and reaction of converting these ions to the starting material again increases, resulting in reduction of the current efficiency. If the electrode spacing is larger than 60 mm, formed metal ions (Nd and Pr) diffuse in the electrolytic bath and the current efficiency is reduced.

The electrolytic bath temperature in the process of the present invention will now be described. When Pr or Pr-Nd metal is prepared, the electrolytic bath temperature can be higher or lower than the melting points of Pr and Nd metals or can be between the melting point of the fused salt and the melting point of Pr or Nd metal. In short, it is sufficient if the temperature of the electrolytic bath is higher than the melting point of the fused salt. For example, if the electrolysis is carried out at an electrolytic bath temperature lower than the melting point of Pr, since Pr is deposited in the form of needles on the surface of the cathode, the cathode can be periodically drawn up to recover deposited Pr. If Pr is deposited in the form of needles and the crystal extends to the anode, a short circuit is formed between the crystal and the anode and the crystal is dissolved and deposited again below the electrode. Accordingly, the metal thus deposited can be recovered. The melting point of Pr is about 930° C., and a temperature higher than this melting point, for example, a temperature of about 950° C. where the critical current density is high and the current efficiency is high, as shown in FIGS. 1 through 4, can be adopted as the temperature of the fused salt. Accordingly, there can be adopted a method in which the operation is carried out at this temperature and Pr is recovered in the form of a liquid. As is apparent from the foregoing description, the operation can be carried out at a fused salt bath temperature higher than the melting points of Pr and Nd or at a fused salt bath temperature between the melting point of the fused salt and the melting point of Pr or Nd.

In the case where a Pr-Fe or Pr-Nd-Fe alloy is prepared, since the melting point of the Pr-Fe alloy at a Pr content of 79 atomic% is 620° C. as is apparent from the phase diagram of Pr-Fe and this melting point is lower than the eutectic point of 730° C. in the phase diagram of $LiF-PrF_3$, by adopting an electrolytic bath temperature higher than the melting point of the electrolytic bath, the deposited Pr-Fe is liquefied on the cathode after the deposition, and since the liquid is heavier than the fused salt, the alloy is deposited in the fused salt below the electrode. Furthermore, the composition of Pr-Fe can be controlled by controlling the electrolysis temperature.

Accordingly, the electrolysis is possible if the electrolytic bath temperature is higher than the melting point of the electrolytic bath. Namely, the electrolytic bath temperature is not lower than 760° C., which is slightly higher than 730° C., and is preferably in the range of 760° to 1100° C. However, if the electrolytic bath temperature is elevated, oxidative consumption of the electrode is increased and damage of the cell material is promoted. Furthermore, from the relations of the electrolytic bath temperature to the critical anode current density, current efficiency, and bath composition, if the bath temperature is either too high or too low, the current efficiency is reduced and the critical anode density is greatly changed. Accordingly, from the economical viewpoint, it is preferred that the electrolytic bath temperature be in the range of about 850° to about 1050° C. determined after general consideration of the above relations.

The temperature of the electrolytic bath can be controlled only by heat generated by an electric current between the electrodes, and in fact, in the conventional fused salt electrolysis process, this internal heating method is often adopted. However, in the process of the present invention, it is preferable to adopt an external heating method in which the bath temperature is controlled by heating the electrolytic bath from the outside by external heating means. The reason is that in the process of the present invention, since the current efficiency is high and the electric conductivity of the electrolytic bath is high, if it is intended to supply heat sufficient to keep the bath temperature constant only by an electric current between the electrodes, the electrode spacing has to be increased beyond the necessary value and it is apprehended that the operation under optimum electrolysis conditions will become impossible. Moreover, when the electrodes are taken out from the bath for repair or exchange thereof, in case of the external heating system, the bath can be maintained in the molten state and re-start of the operation and adjustment of the production can be facilitated. Moreover, in case of the external heating system, electrolysis conditions such as the electrolysis temperature and the composition can easily be controlled and optimum operation conditions can easily be maintained. Furthermore, as pointed out hereinbefore, large quantities of products can be manufactured efficiently with a small amount of the expensive fused salt.

In view of the bath composition and bath conditions used in the present invention, it is sufficient if the electrolytic cell is formed of an anti-corrosive material. Austenite type stainless steels [SUS-304, SUS-316 and SUS-3103 specified in Japanese Industrial Standards (JIS)] are preferably used because they are not expensive and have a high durability to the fused salt.

In connection with the corrosion resistance of the electrolytic cell and the recovered metal, since Pr or Nd metal or a Pr or Nd alloy such as Pr-Fe or Pr-Nd-Fe is liable to form an alloy with other metal, a vessel (receiver) for receiving a product such as Pr, Pr-Nd, Pr-Fe, or Pr-Nd-Fe in the liquid form in the electrolytic bath should be formed of a material not liable to form an alloy, such as tantalum, tungsten, or molybdenum, and from the results of investigations made by us, it has been confirmed that tantalum is most preferable. Since these metals such as tantalum are expensive, only the portion of the receiver, falling in contact with Pr, Pr-Nd, or an Fe alloy thereof, can be lined with tantalum or the like. In the case where a Pr-Fe or Pr-Nd-Fe alloy is prepared, if an inclination is formed on the bottom side of the plate-shaped cathode and the top end is projected so that liquid drops of the alloy are collected at this projection end and the formed alloy is allowed to drop down from this one point, the necessary size of the receiver can be diminished. It is sufficient if the shape of the lower end of the cathode is such a tapered shape that liquid drops are collected at one point without dispersion, dropping, or remaining on the lower end of the cathode.

Nd, Pr, Pr-Nd, or an Fe alloy thereof collected in the receiver or the bottom portion of the electrolytic cell can be directly recovered from a metal take-out opening formed through the wall of the electrolytic cell. However, the metal or alloy can be recovered simply by a method comprising sucking up the liquid under vacuum through a pipe introduced into the electrolytic bath or receiver from above the electrolytic bath.

The process for preparing Pr, Pr-Nd, or an Fe alloy thereof according to the present invention is characterized in that, as pointed out hereinbefore, the operation can be carried out at a high anode current density and a high current efficiency, that is, economically advantageously. As is apparent from FIGS. 2 through 5 and examples given hereinafter, the electrolysis operation can be carried out stably at a high anode current density of at least 0.5 $A/cm^2$, preferably at least 1.0 $A/cm^2$, more preferably at least 1.2 $A/cm^2$, especially preferably at least 1.3 $A/cm^2$ and at a high current efficiency of at least 50%, preferably at least 70%, especially preferably at least 80%. In the instant specification, the anode current density is the value obtained by dividing the average current of the anode by the anode area, and the anode area is the area of the portion, confronting the cathode, of the anode. The current efficiency is the value obtained by dividing the quantity of the formed metal by the theoretical electrolysis quantity determined from the supplied electric current by Faraday's equation.

An embodiment of the operation in the process of the present invention will now be described with reference to the accompanying drawings.

Figure 9A:
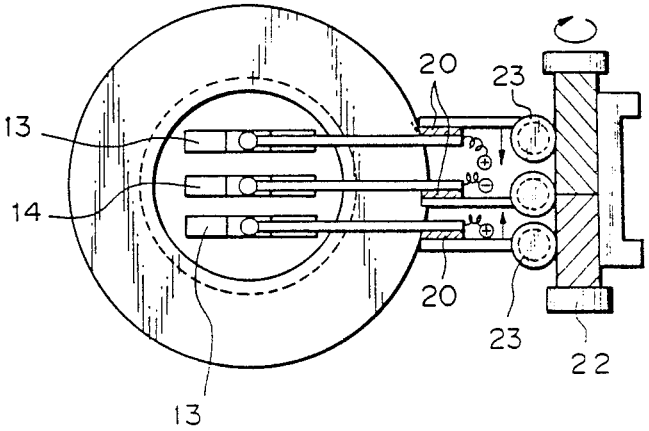
FIGS. 9A and 9B are diagrams illustrating an apparatus for use in carrying out the process of the present invention.
Figure 9B:
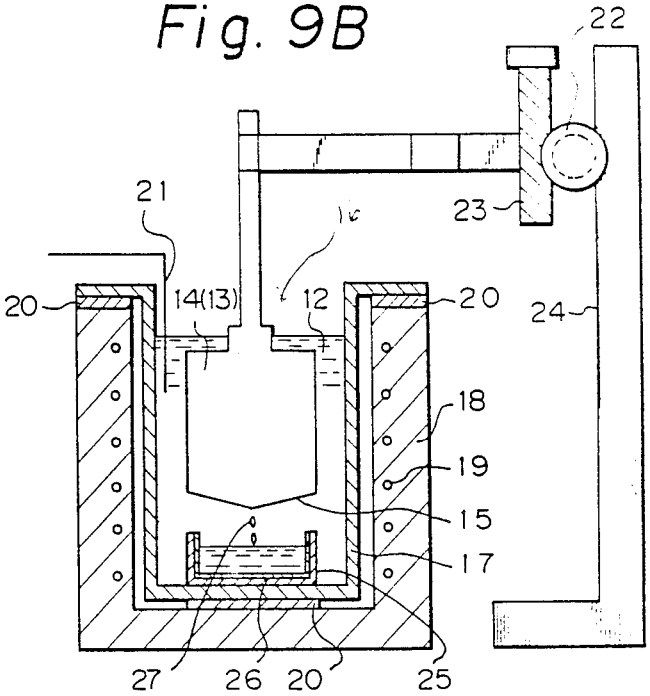

FIGS. 9A and 9B show an electrolytic apparatus for use in carrying out this embodiment, in which FIG. 9A is a plane diagram and FIG. 9B is a longitudinally sectional diagram. A plate-shaped anode 13 and a plate-shaped cathode 14 are immersed in an electrolytic bath 12, and the cathode 14 is located at the center and anodes 13 are arranged on both the sides of the cathode 14 to confront the cathode 14. In the case where the cathode 14 is formed of iron, in order to gather drops of a Pr-Fe or Pr-Nd-Fe alloy at one point, the bottom side 15 of the cathode 14 is formed to have a tapered shape having a projection at the center. The upper portion of the electrolytic cell 12 is exposed to the open air 16, and the inner wall surface of the bath tank is formed of an austenite type stainless steel. An external heating furnace 18 is arranged around the bath tank and is provided with a heat generator 19. Reference numeral 20 represents an insulating plate. The temperature of the electrolytic bath 12 is detected by a thermocouple 21 and is adjusted by controlling the heat generator 19 by an external heating furnace control device (not shown). The plate-shaped electrodes 13 and 14 are suspended from above and are supported by an electrode attachment stand 24 through an electrode spacing adjusting machine 22 and an electrode lift 23. The electrode spacing adjusting machine 22 and electrode lift 23 are of the worm gear system, and by turning them, the electrodes 13 and 14 can be moved in the horizontal direction and vertical direction. A receiver 25 for recovering Pr, Pr-Nd, or an Fe alloy thereof is disposed in the electrolytic cell, and the inner surface of the receiver 25 is lined with tantalum. In this embodiment, the upper portion of the electrolytic cell is exposed to the open air, but the upper portion of the electrolytic cell can be enclosed so that an atmosphere having a specific oxygen concentration is maintained in the electrolytic cell.

In this electrolysis apparatus, a PrF or a $PrF_3$-$NdF_3$ mixture is used as the starting material and the electrolysis is carried out under a specific bath composition, bath temperature, current, and voltage conditions, and Pr, Pr-Nd, or an Fe alloy thereof is dropped and recovered into the receiver 25 from the cathode 14. During the electrolysis, the electrodes are consumed and the electrode spacing is changed. Accordingly, by using the electrode spacing adjusting machine 22, the electrodes are moved while taking the other electrolysis conditions into consideration, so that the electrode spacing is kept constant, whereby constant electrolysis conditions can be maintained.

When the electrolysis is conducted in a continuous manner, the operation is carried out by attaching a device for continuously feeding the starting material, a device for pumping up the metal, and other accessory means to the above-mentioned electrolysis apparatus.

The present invention will now be described in detail with reference to the following examples, that by no means limit the scope of the invention.

EXAMPLE 1

In the apparatus shown in FIGS. 9A and 9B, the electrolysis was carried out by using various LiF-$PrF_3$ mixtures differing in composition to examined influences of this composition and the bath temperature on the critical current density and current efficiency. Pr-Fe and Pr-Nd-Fe alloys were formed as the metal product. In order to improve the ease of operation, reduce the equipment cost, and increase the product purity, the operation was carried out in the open air (oxidizing atmosphere). Two graphite plate-shaped anodes 13 were arranged on both sides of an iron plate-shaped cathode 14 located at the center to confront the cathode 14.

The relation among the critical anode current density, bath composition, and bath temperature, observed when the Pr-Fe alloy was prepared in the above-mentioned manner, is shown in FIG. 1.

Figure 2:
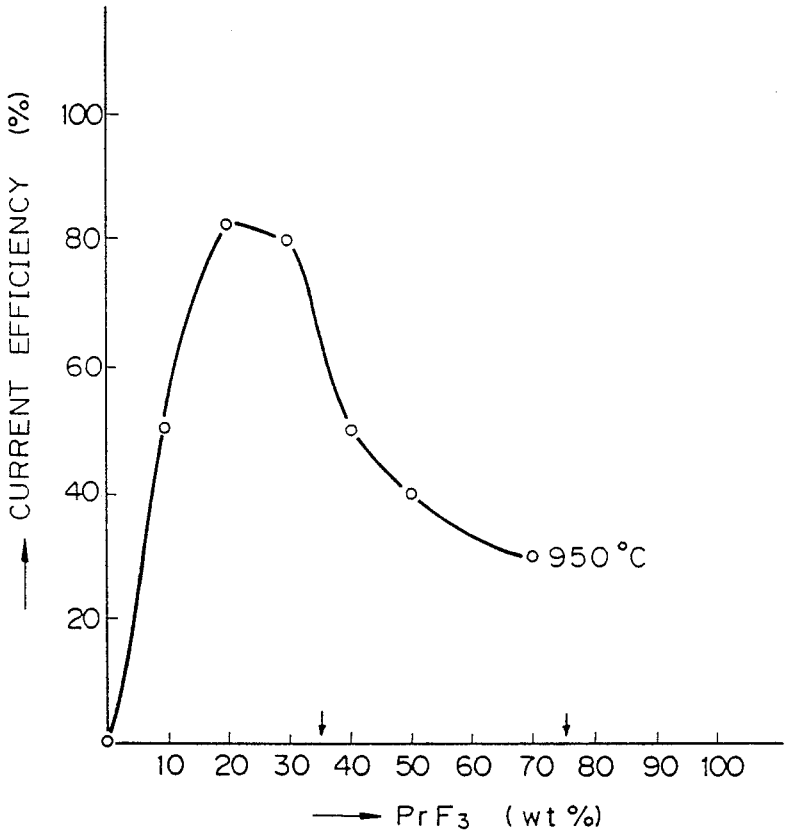
FIG. 2 is a graph illustrating the relation of the current efficiency to the bath composition in the same electrolysis as in FIG. 1.

The relation between the bath composition and current efficiency, observed when the electrolytic bath temperature was fixed at 950° C., is shown in FIG. 2.

From FIGS. 1 and 2, it is understood that the composition giving a high critical current density, a high current efficiency, and a good productivity comprises 5 to 34% by weight of $PrF_3$.

When experiments were similarly carried out by using mixtures of $PrF_3$ and $NdF_3$ as the starting material, results similar to those mentioned above were obtained.

EXAMPLE 2

The electrolysis was carried out by using various LiF-$PrF_3$ mixtures differing in the composition to examine influences of the composition and temperature on the critical current density and current efficiency. Pr metal and Pr-Nd metal were formed as the metal product. The electrolysis was carried out in the same manner as described in Example 1 except that a graphite plate-shaped cathode was used as the cathode 14.

The receiver shown in Example 1 is effective when the operation is carried out at an electrolytic bath temperature higher than the melting point of Pr. However, when the operation is carried out at a temperature lower than the melting point of Pr, the receiver need not particularly be used.

Figure 3:
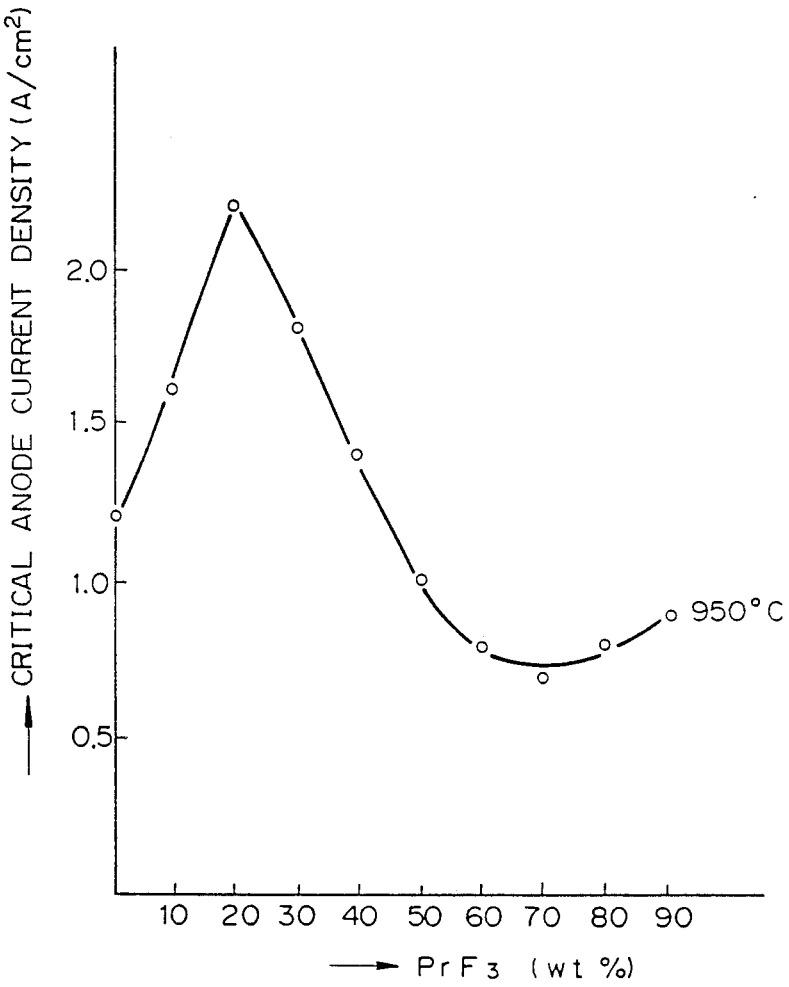
FIG. 3 is a graph similar to the graph shown in FIG. 1 in the electrolysis for the production of Pr metal in a mixed bath of $PrF_3$ and LiF.
Figure 4:
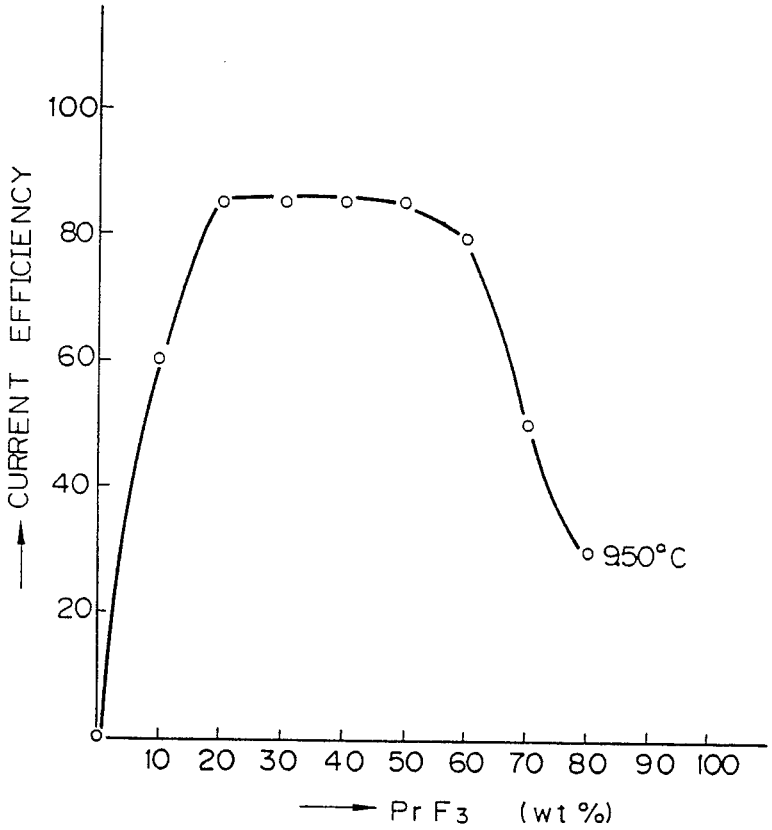
FIG. 4 is a graph similar to the graph shown in FIG. 2 in the same electrolysis as in FIG. 3.
Figure 5:
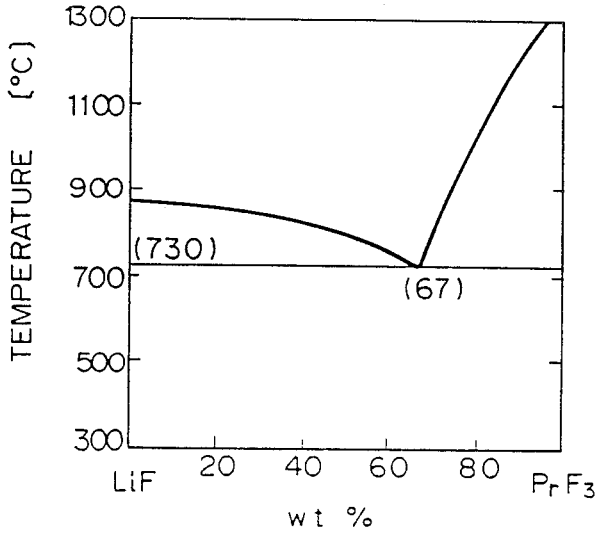
FIG. 5 is a phase diagram of LiF-$PrF_3$.

The obtained results are shown in FIGS. 3 and 4. It is understood that the composition giving a high critical anode current density and a high current efficiency comprises 5 to 75% by weight of $PrF_3$.

When mixtures of $PrF_3$ and $NdF_3$ were used as the starting material, similar results were obtained.

EXAMPLE 3

A Pr-Fe alloy was prepared by using the apparatus shown in FIGS. 9A and 9B. Two plate-shaped graphite anodes were used and arranged on both the sides of a central iron cathode, and the Pr-Fe alloy was deposited.

The fused salt used comprised 20% by weight of $PrF_3$ and 80% by weight of LiF, and $PrF_3$ was supplied to the electrolytic cell to compensate for $PrF_3$ consumed by the electrolysis, so that the composition of the electrolytic bath was kept substantially constant.

The electrolysis conditions and obtained results are shown in Table 1. It is understood that the Pr-Fe alloy could be recovered very efficiently and the contents of oxygen and carbon as impurities in the alloy were very low. Since $PrF_3$ was used as the starting material, the recovered alloy was an Nd-free Pr-Fe alloy.

EXAMPLE 4

A Pr-Nd-Fe alloy was prepared in the same manner by using the same apparatus as in Example 3 except that a $PrF_3$-$NdF_3$ mixture was used as the starting material.

The electrolysis conditions and obtained results are shown in Table 1. Since the $PrF_3$-$NdF_3$ mixture was used as the starting material, the obtained metal was a Pr-Nd-Fe alloy.

EXAMPLE 5

Pr metal was prepared by using the apparatus shown in FIGS. 10A and 10B. Two plate-shaped graphite anodes were used and arranged on both the sides of a central graphite cathode, and Pr metal was deposited.

The fused salt used comprised 20% by weight of $PrF_3$ and 80% by weight of LiF, and $PrF_3$ was supplied into the electrolytic cell to compensate for $PrF_3$ consumed by the electrolysis, whereby the electrolytic bath composition was kept substantially constant.

The electrolysis conditions and obtained results are shown in Table 1. Pr metal was recovered.

EXAMPLE 6

Pr-Nd metal was prepared in the same manner as described in Example 5 except that a mixture of $PrF_3$ and $NdF_3$ was used as the starting material.

The electrolysis conditions and obtained results are shown in Table 1.

Since the $PrF_3$-$NdF_3$ mixture was used as the starting material, the formed metal was a Pr-Nd alloy.

TABLE 1

| | Example 3 | Example 4 | Example 5 | Example 6 |
|---|---|---|---|---|
| electrolysis atmosphere | open air | open air | open air | open air |
| shape and material of electrode: | | | | |
| anode A | plate-shaped graphite | plate-shaped graphite | plate-shaped graphite | plate-shaped graphite |
| cathode | plate-shaped iron | plate-shaped iron | plate-shaped graphite | plate-shaped graphite |
| anode B | plate-shaped graphite | plate-shaped graphite | plate-shaped graphite | plate-shaped graphite |
| size of electrode (portion in bath): | | | | |
| anode A (cm) | $14^W \times 10^H \times 1.5^D$ | $14^W \times 10^H \times 1.5^D$ | $14^W \times 10^H \times 1.5^D$ | $14^W \times 10^H \times 1.5^D$ |
| cathode (cm) | $14^W \times 10^H \times 1.5^D$ | $14^W \times 10^H \times 1.5^D$ | $14^W \times 10^H \times 1.5^D$ | $14^W \times 10^H \times 1.5^D$ |
| anode B (cm) | $14^W \times 10^H \times 1.5^D$ | $14^W \times 10^H \times 1.5^D$ | $14^W \times 10^H \times 1.5^D$ | $14^W \times 10^H \times 1.5^D$ |
| size of electrolytic cell (cm) | $18\ \phi \times 25^H$ | $18\ \phi \times 25^H$ | $18\ \phi \times 25^H$ | $18\ \phi \times 25^H$ |
| composition of fused salt bath: | | | | |
| LiF (wt %) | 20 | 20 | 20 | 20 |
| $PrF_3$ (wt %) | 80 | — | 80 | — |
| $PrF_3$—$NdF_3$ mixture (wt %) | — | 80 | — | 80 |
| electrolysis temperature (°C.) | 950 | 950 | 950 | 950 |
| electrolysis results: | | | | |
| critical current value (A) | 590 | 620 | 590 | 650 |
| electrolysis time (Hr) | 7 | 7 | 7 | 7 |
| average voltage (V) | 9 | 9 | 8 | 8 |
| average current (A) | 400 | 420 | 400 | 450 |
| average anode current density ($A/cm^2$) | 1.43 | 1.50 | 1.43 | 1.61 |
| average cathode current density ($A/cm^2$) | 2.86 | 3.00 | 2.83 | 3.22 |
| recovered alloy amount (g) | 4900 | 5274 | 4067 | 4686 |
| Pr content (%) | 80 | 60 | 100 | 80 |
| Nd content (%) | 0 | 20 | 0 | 20 |
| Fe content (%) | 20 | 20 | 0 | 0 |
| C content (p.p.m) | 100 | 100 | — | — |
| O content (p.p.m) | 250 | 200 | — | — |
| current efficiency (%) | 80 | 82 | 83 | 85 |

As is apparent from the foregoing description, according to the fused salt electrolysis process of the present invention, a Pr-Fe or Pr-Nd-Fe alloy or Pr or Pr-Nd metal can be prepared at a high current density and a high current efficiency by using small equipment highly efficiently and economically industrially. Moreover, the following advantages can be attained according to the present invention.

(1) An iron alloy and a pure metal can be simply prepared by using and exchanging an iron cathode and a graphite cathode.

(2) A metal having reduced contents of impurities degrading the performance of a magnetic material, such as oxygen and carbon, can be prepared.

(3) Since a sealing device using a protecting gas need not be used, the construction and maintenance costs of equipment can be reduced, and supply and withdrawal of the starting material, auxiliary starting material, and product can be facilitated.

I claim:

1. A process for preparing a praseodymium-iron alloy or a praseodymium-neodymium-iron alloy, which comprises electrolyzing (1) using praseodymium fluoride ($PrF_3$) or (2) a mixture of praseodymium fluoride and neodymium fluoride ($NdF_3$) as a starting material and carrying out the electrolysis in a fused salt bath having a composition comprising substantially 5 to 34% by weight of $PrF_3$ or a mixture of $PrF_3$ and $NdF_3$ and 95 to 66% by weight of lithium fluoride (LiF) by using an iron cathode.

2. A process according to claim 1, wherein the process comprises arranging a plate-shaped carbon electrode as an anode and a plate-shaped iron electrode as a cathode in the fused salt bath so that the electrodes confront each other in the bath and conducting the electrolysis.

3. A process according to claim 2, wherein the process comprises arranging one plate-shaped cathode at the center, a pair of plate-shaped anodes on both sides of the cathode to confront the cathode, and conducting the electrolysis.

4. A process according to claim 2, wherein the distance between the plate-shaped anode and the plate-shaped cathode is 10 to 60 mm.

5. A process according to claim 1, wherein the process comprises covering the fused salt bath with an atmosphere containing oxygen at a concentration sufficient to oxidize and consume powdery carbon generated from a carbon electrode and floating on the surface of the fused salt bath.

6. A process according to claim 5, wherein the atmosphere above the bath contains 10 to 40% by volume of oxygen.

7. A process according to claim 6, wherein the atmosphere above the bath contains 15 to 30% by volume of oxygen.

8. A process according to claim 7, wherein the atmosphere above the bath is air.

9. A process according to claim 1, wherein the fused salt bath further contains up to 50 parts by weight of a flux to 100 parts by weight of the total weight of LiF and $PrF_3$ and, if present, $NdF_3$.

10. A process according to claim 1, wherein the anode current density of the electrolysis is above 0.5 $A/cm^2$.

11. A process according to claim 1, wherein the current efficiency of the electrolysis is above 50%.

12. A process according to claim 1, wherein the deposited praseodymium-iron alloy of praseodymium-neodymium-iron alloy contains not more than 200 ppm of carbon.

13. A process according to claim 12, wherein the carbon content in the alloy is not more than 100 ppm.

14. A process according to claim 1, wherein the process comprises conducting the electrolysis out to deposit the praseodymium or praseodymium-neodymium alloy on the iron cathode and drop the praseodymium-iron alloy or praseodymium-neodymium-iron alloy below the cathode to collect the alloy at the bottom of the bath.

15. A process according to claim 1, wherein the fused salt bath has a temperature of 760° to 1100° C.

16. A process according to claim 15, wherein the temperature of the fused salt bath is 850 to 1050° C.

17. A process according to claim 1, wherein the process comprises heating the fused salt bath is heated by heating means outside the bath.

18. A process for preparing praseodymium metal or a praseodymium-neodymium alloy, which comprises electrolyzing (1) praseodymium fluoride ($PrF_3$) or (2) a mixture of praseodymium fluoride and eodymium fluoride ($NdF_3$) as a starting material in a fused salt bath having a composition comprising 5 to 75% by weight of $PrF_3$ or a mixture of $PrF_3$ and $NdF_3$ and 95 to 25% by weight of lithium chloride (LiF) using a plate-shaped carbon electrode as an anode and a plate-shaped carbon or infusible material electrode as a cathode arranged in the fused salt bath so that the electrodes confront each other in the bath.

19. A process according to claim 18, wherein one plate-shaped cathode is arranged at the center, a pair of plate-shaped anodes are arranged on both sides of the cathode to confront the cathode, and the electrolysis is carried out in this state.

20. A process according to claim 18, wherein the distance between the plate-shaped anode and the plate-shaped cathode is 10 to 60 mm.

* * * * *

UNITED STATES PATENT AND TRADEMARK OFFICE

CERTIFICATE OF CORRECTION

PATENT NO. : 4,966,662

DATED : October 30, 1990

INVENTOR(S) : Hideo Tamamura

It is certified that error appears in the above-identified patent and that said Letters Patent is hereby corrected as shown below:

On the title page:

Section [54], line 2, delete "PRASEODYNIUM" and insert --PRASEODYMIUM--.

Column 1, line 1, delete "PRASEODYNIUM" and insert--PRASEODYMIUM--.

Signed and Sealed this

Twenty-eighth Day of April, 1992

*Attest:*

HARRY F. MANBECK, JR.

*Attesting Officer*

*Commissioner of Patents and Trademarks*